US011808290B1

(12) United States Patent
Mittal et al.

(10) Patent No.: US 11,808,290 B1
(45) Date of Patent: Nov. 7, 2023

(54) FLUID FLOW CONDITIONING APPARATUS

(71) Applicant: University of South Florida, Tampa, FL (US)

(72) Inventors: Rajat Mittal, Tampa, FL (US); Dharendra Yogi Goswami, Tampa, FL (US)

(73) Assignee: University of South Florida, Tampa, FL (US)

( * ) Notice: Subject to any disclaimer, the term of this patent is extended or adjusted under 35 U.S.C. 154(b) by 79 days.

(21) Appl. No.: 17/556,423

(22) Filed: Dec. 20, 2021

Related U.S. Application Data

(60) Provisional application No. 63/199,292, filed on Dec. 18, 2020.

(51) Int. Cl.
*F15D 1/02* (2006.01)
*F15D 1/06* (2006.01)

(52) U.S. Cl.
CPC ..... *F15D 1/025* (2013.01); *F15D 1/06* (2013.01)

(58) Field of Classification Search
CPC ..... F15D 1/025; F15D 1/06
USPC ..... 138/43, 45, 46
See application file for complete search history.

(56) References Cited

U.S. PATENT DOCUMENTS 2,593,315 A * 4/1952 Kraft ..... G05D 7/012 138/45
3,750,710 A * 8/1973 Hayner ..... G05D 7/012 138/40
4,003,405 A 1/1977 Hayes et al.
4,377,968 A * 3/1983 Gerry ..... F24F 13/08 454/227
4,884,750 A * 12/1989 Werding ..... B65D 83/20 239/533.1
5,099,881 A 3/1992 Nakajima
5,582,210 A * 12/1996 Bartholomew ..... G05D 7/0106 138/45
6,634,388 B1 10/2003 Taylor et al.
(Continued)

OTHER PUBLICATIONS

Agrawal, A. K. Laminar fluid flow and heat transfer in an annulus with an externally enhanced inner tube. Int. J. Heat and Fluid Flow, vol. 14, No. 1, Mar. 1993.

*Primary Examiner* — Craig M Schneider
*Assistant Examiner* — David R Deal
(74) *Attorney, Agent, or Firm* — Nicholas Pfeifer; Smith & Hopen, P.A.

(57) ABSTRACT

A fluid flow conditioning apparatus having self-adjusting tab members that reduce flow losses within a conduit. A plurality of tabular members is affixed to an insertion plate-type flow conditioner. Tabular members are cojoined in pairs at their leading edges. When the cojoined pair of the first tabular member and the second tabular member are placed into a fluid flow, an angle between the first tabular member and the second tabular member is configured to decrease in response to static and dynamic pressure exerted onto the outer surfaces of the tabular members by the fluid flow. The tabular members may be made of a hyperplastic material configured to undergo an elastic deformation and exhibit flapping due to the dynamic pressure of the fluid flow. Tabular members maybe cojoined by a hinge configured to partially close in response to pressure exerted by the fluid flow, decreasing the angle between the tabular members.

20 Claims, 10 Drawing Sheets

(56) References Cited

U.S. PATENT DOCUMENTS

| | | | | |
|---|---|---|---|---|
| 7,481,244 | B2 * | 1/2009 | Bivin | G05D 7/0173 366/337 |
| 8,167,002 | B2 * | 5/2012 | Kuhne | G05D 7/0113 137/504 |
| 8,387,950 | B2 * | 3/2013 | Hummel | B64D 15/04 60/785 |
| 9,506,484 | B2 | 11/2016 | Brown | |
| 10,336,028 | B1 * | 7/2019 | Katz | B23B 7/00 |
| 10,444,768 | B2 * | 10/2019 | Lee | E03C 1/08 |
| 10,487,740 | B2 * | 11/2019 | Dehais | F02C 7/18 |
| 2014/0080402 | A1 * | 3/2014 | Staelgraeve, II | F24F 13/08 454/239 |
| 2014/0338771 | A1 | 11/2014 | Brown | |
| 2015/0211553 | A1 * | 7/2015 | Laird | F15D 1/025 138/44 |

* cited by examiner

FLUID FLOW CONDITIONING APPARATUS

PRIORITY CLAIM

This non-provisional patent application is a continuation of and claims priority to a U.S. Provisional Application No. 63/199,292 filed Dec. 18, 2020.

BACKGROUND OF THE INVENTION

1. Field of the Invention

This invention relates to devices that condition fluid flow within a conduit. More specifically, the invention pertains to a fluid flow conditioning apparatus having self-adjusting cojoined tab members that reduce flow losses within a conduit.

2. Brief Description of the Related Art

As dependency on fossil fuels decreases, share of renewable energy sources—such as solar and wind—for power generation is growing. However, weather changes can cause fluctuations in renewable energy generation, strongly affecting reliability and availability of the renewable energy source. Thus, effective and efficient energy storage systems are key to optimal utilization of renewable energy sources.

To counter intermittency and expand capacity of renewable solar energy resource for power generation, energy storage systems with easy grid integration are necessary. Thus, the need for long-term energy storage systems is increasing. Large energy storage systems help to stabilize the power grid by compensating for the energy generation fluctuations in real-time. Latent Heat Based Thermal Energy Storage (LHTES) systems can offset energy fluctuations experienced by the power grid. For this reason, there is an avid interest among researchers for inventing way to decrease material usage, increase energy density, and reduce cost with respect to LHTES system.

Research shows that LHTES systems suffer from two major drawbacks. Firstly, non-uniform and slow charging rate of the energy storage capsules leads to higher heat losses. Secondly, increase in the pressure drop introduced in the flow conduit in the upstream section of the system contributes to the lowering and slowing down of the heat transfer from the heated airflow to the energy storage material within a tank. One of the key reasons for the decrease in the energy efficiency of the system is presence of fluid flow irregularities found in the upstream lengths of the tank due to a bend in the flow channel.

Currently known flow-conditioning devices, such as the one disclosed in US Pat. Pub. No. 2014/0338771, produce significant pressure drops when positioned in the flow channel, causing the fluid flow profile to resemble that of laminar flow. This fluid flow profile has high velocity heads in the center, thus making the flow profile uneven. Furthermore, these prior art devices develop a more parabolic and a less dispersed velocity profile—and, as a result, they exhibit decreased rate of heat transfer and charging of the system.

Controlling the flow of the heat transfer fluid through a heat exchanger with least possible expenditure of energy, while reducing maintenance requirements and extending life of the system is essential. Failing to control flow characteristics for the heat exchanger application leads to slow and uneven charging, reduced energy storage, damage caused due to corrosion and decrease in total system life. For efficient and productive operation, heat exchangers applications require stable upstream flow profiles in the fluid conduits before the heat transfer fluid enters the heat exchanger. Irregular and uneven flows at reduced pressures often result in decreased overall energy efficiency of the system and, thus, affect the rate and uniformity of the charging of the thermal energy storage.

Presence of inline elbows, which are commonly used to reduce straight pipe runs, due to space restrictions, result in generation of swirl and distortion in the velocity profile of the fluid flow within a pipeline. Flow distortion create pressure changes in the system, reducing the net positive thermal energy gain. If not corrected, these flow distortions result in excess noise and system erosion, which lead to reduced life of heat exchanging tubes. An inline elbow flow conditioner can be installed upstream from the heat exchanger to ensure an optimal flow profile, for heat exchanger's its efficient operation. Flow profile distortions such as swirl, asymmetry, and non-flatness can be isolated in the pipeline to give rise to more repeatable, symmetrical and relatively flat flow profiles with minimal losses in pressure.

Generation of more benign operating environments by providing conditioned flow streams entering at the inlet of the heat exchanger in an equally distributed pattern and uniformity enables in increasing the system life, reducing maintenance cost, noise, and risks to corrosion. Heat exchangers are adversely affected by flow disturbances occurring upstream of the flow conduit. Many flow conditioning applications are not designed with straight-run piping, for example, because of the imposed space constraints.

Therefore, what is needed is a novel flow conditioning apparatus configured to enhance and improve heat transfer characteristics for the system designed for high temperature heat exchanger applications, such as LHTES systems.

SUMMARY OF THE INVENTION

The problem stated above is now resolved by a novel and non-obvious fluid flow conditioning apparatus. In an embodiment, the fluid flow conditioning apparatus includes a first tabular member having a first leading edge, a first trailing edge, a first outer surface, and a first inner surface and a second tabular member having a second leading edge, a second trailing edge, a second outer surface, and a second inner surface. The leading edges of the first and the second tabular members are cojoined. When the conjoint tabular members are placed into a fluid flow, an angle between the first tabular member and the second tabular member is configured to decrease in response to increasing a Reynold's number of the fluid flow. Likewise, the distance between the first trailing edge of the first tabular member and the second trailing edge of the second tabular member is also configured to decrease as the Reynold's number of the fluid flow increases. In this manner, the cojoined tubular members are configured to adjust the shape of their collectively assembly based on the characteristics of the fluid flow—specifically, the static and dynamic pressure.

In an embodiment, the first and the second tabular members can be made of an elastomeric material, for example a hyperplastic material. The elastomeric material is configured to undergo an elastic deformation in response to a dynamic pressure of the first fluid flow being exerted onto the outer surfaces of the cojoined tabular members. In this manner, the elastic deformation of the elastomeric material reduces a drag coefficient of the cojoined tabular members. Furthermore, flexible tabular members can be configured to exhibit flapping in response to changes in dynamic pressure of the fluid flow. This flapping behavior of the tabular members generates vortices in the downstream fluid flow, thereby increasing intermixing thereof.

In an embodiment, the first tabular member and the second tabular member can be cojoined via a hinge. The hinge can biased, such that the pressure exerted onto the outer surfaces of the tabular members by fluid flow partially closes the hinge against the biasing force. The biasing force is configured at least partially open the hinge in response to a reduction in the pressure exerted onto the tabular members by the fluid flow. Furthermore, a biasing element—such as a spring—may be disposed at the hinge or between the cojoined tabular members. The biasing element biases the hinge toward an open configuration. In this embodiment, the pressure exerted onto the tabular members by the fluid flow at least partially closes the hinge against a biasing force of the biasing element. Furthermore, when tabular members are cojoined via a hinge, the tabular members may be flexible or rigid. In the case the tabular members are rigid, the will generate tip vortices in a downstream fluid flow, thereby increasing intermixing thereof.

The cojoined tabular members described above can be affixed to an insertion plate-type flow conditioner. In an embodiment, fibrous structures can disposed within apertures of the insertion plate-type flow conditioner, such that the fibrous structures will facilitate creation of eddies within a downstream fluid flow.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1A:
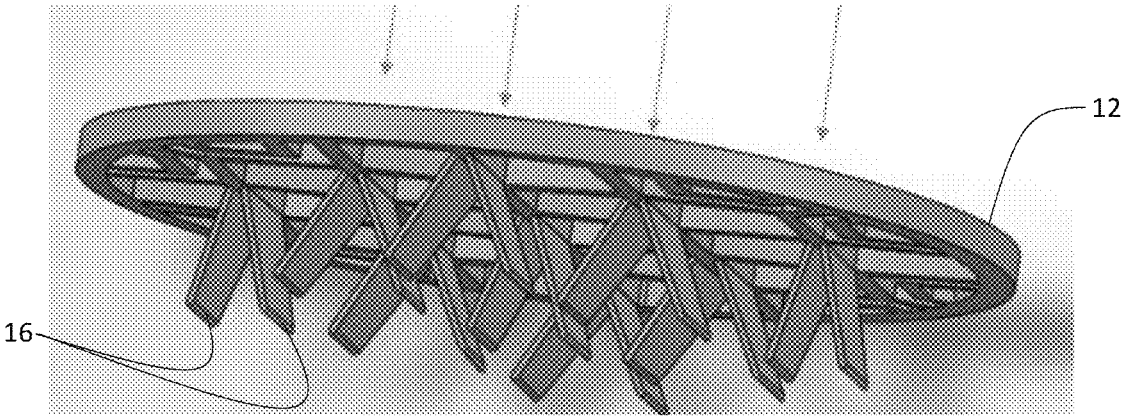
FIG. 1A (Prior Art)
FIG. 1A is a perspective side view of an insertion plate-type flow conditioner having stationary, rigid tabs for fluid flow conditioning.
Figure 1B:
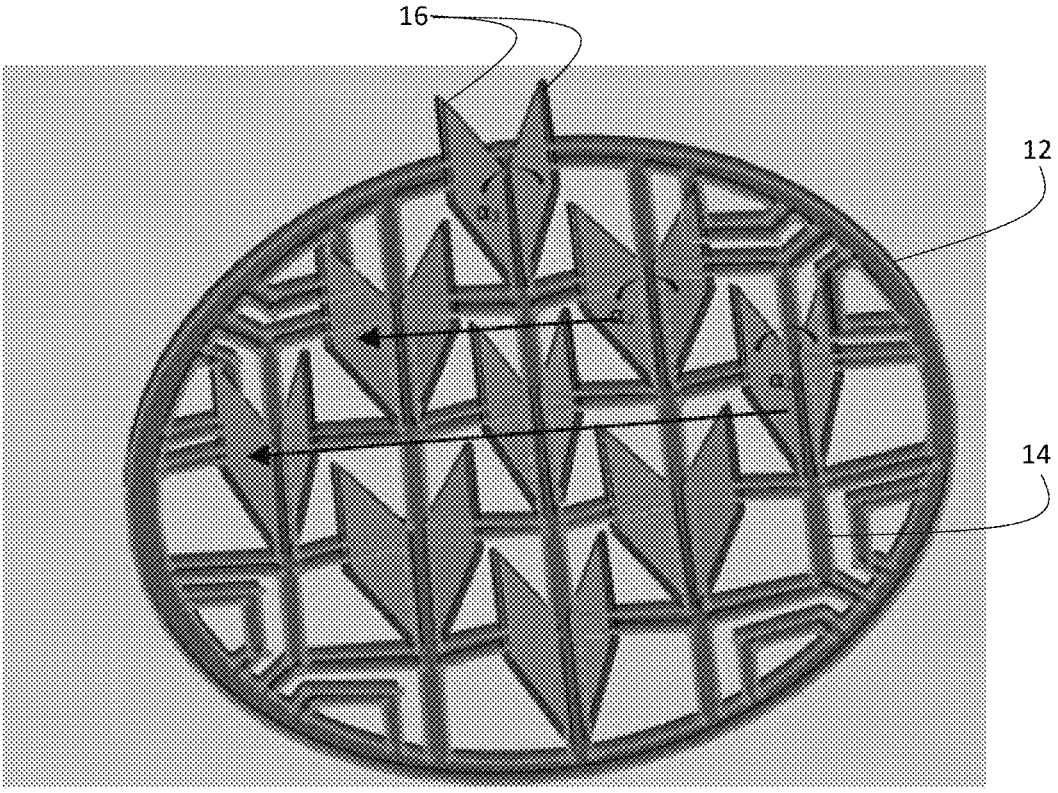
FIG. 1B (Prior Art)
FIG. 1B is a perspective bottom view of an insertion plate-type flow conditioner having stationary, rigid tabs for fluid flow conditioning.

FIGS. 1A and 1B depict an insertion plate-type flow conditioner 12 having a trapezoidal grid 14 and a plurality of tabs 16. Pairs of tabs 16 are arranged in an angular orientation relative to one another. FIG. 1B depicts three angles—$\alpha_1$, $\alpha_2$, and $\alpha_3$—between three pairs of tabs 16 positioned in three different locations relative to trapezoidal grid 14 of insertion plate flow conditioner 12.

Figure 2:
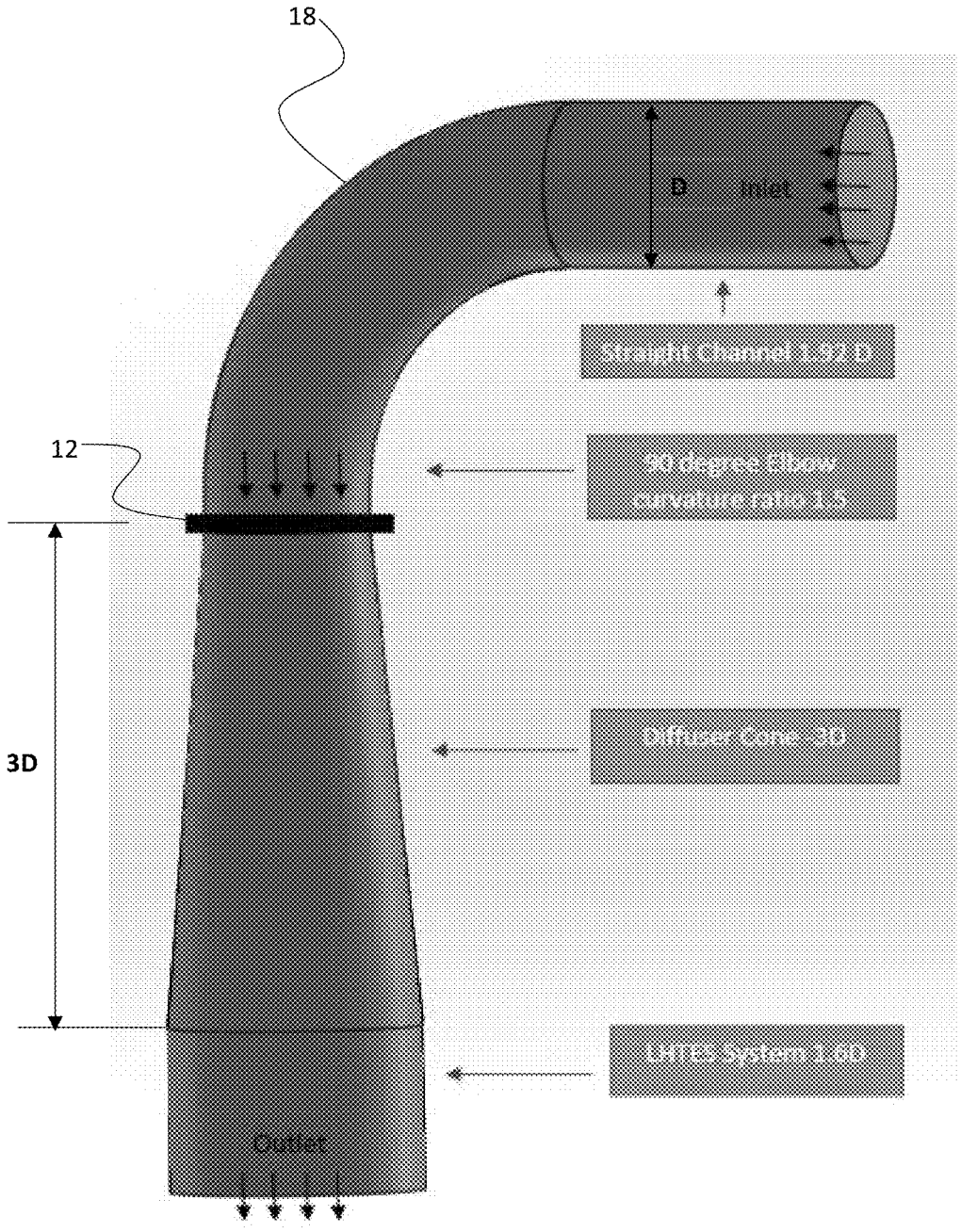
FIG. 2 is a schematic depiction of a conduit used to obtain data demonstrating efficiency of tab-pairs at various angles.

FIG. 2 shows an exemplary flow conduit 18. In this exemplary flow conduit 18, fluid flow passes through a straight circular channel of twelve inches in length. The flow conduit curves and forms a 90-degree bend in the same plane, with curvature ration value of 1.5. Diffuser cone of variable diameter connects the elbow to the inlet of the tank having an installation length of three diameters of the inlet channel. Insertion plate flow conditioner 12 is positioned in close proximity to the 90-degree bend.

Definition Of Parameters

Horizontal and vertical flatness efficiency parameters have been defined to quantify the flatness of the flow profile, which is the difference between the fully developed and distorted flow profile for a flow conditioning system. Parameters $\sigma_h$ and $\sigma_v$ represent deviation in the effective flow profile of conduit 18. In the Table 1 below, $\sigma_h$ and $\sigma_v$ were measured at a distance three times the length of the diameter of conduit 18 from the bend, with the fully developed flow profile.

$$\sigma_h = \sqrt{\frac{\sum (U_h - U_{href})^2}{n}}$$

$$\sigma_v = \sqrt{\frac{\sum (U_v - U_{vref})^2}{n}}$$

Here, $U_{href}$, $U_{vref}$ and $U_h$, $U_v$ are the fully developed axial velocities and effective velocities in vertical and horizontal plane respectively with the flow conditioning device.

$$\eta_{h(z)} = \frac{\sigma_{h'_{i(z)}} - \sigma_{h''_{i(z)}}}{\sigma_{h'_{i(0)}} - \sigma_{h'_{i(z)}}}$$

$$\eta_{v(z)} = \frac{\sigma_{v'_{i(z)}} - \sigma_{v''_{i(z)}}}{\sigma_{v'_{i(0)}} - \sigma_{v'_{i(z)}}}$$

Variables $\sigma_{hi(z)}'$ and $\sigma_{hi(z)}''$ represent values of flatness efficiency calculated for the same system configuration with and without flow conditioner 12, wherein the distance z is evaluated as z=0 (placed immediately after the disturbance causing element, here elbow). Therefore, these parameters measure the relative efficiency of the flow-conditioning device with respect to the system without flow conditioner as the distance z from the piping element varies. Here, z equals to the length that is 3 diameters from the bend. Therefore, higher is the efficiency parameter for the conditioner, greater is its flow conditioning performance relative to the system without flow conditioning.

Next, variable $Pt_r$ is used to represent the relative pressure drop. $Pt_0$ (Eq. 2) is an area weighted average pressure at the inlet ($Pt_{01}$) and at three diameters from the bend ($Pt_2$), Refer FIG. 1 and $Pt_{01}$—$Pt_2$ is the total pressure drop between two sampling locations. $Pt_r$ is Relative Total Pressure Drop (Eq. 2).

Relative Total Pressure Drop for the section defines how much total pressure energy is lost with respect the total inlet pressure energy.

$$\frac{Pt_{01} - Pt_{02}}{Pt_{01}} = Pt_r \quad \text{Eq. 1}$$

$$\frac{\sum_{i=1}^{i=n} A_i Pt_{i0}}{\sum_{i=1}^{i=n} A_i} \quad \text{Eq. 2}$$

As the value of the parameter $Pt_r$ approaches zero, the pressure drops across the measurement section decreases, which means that more total energy is available at the inlet of the energy storage tank.

Figure 3A:
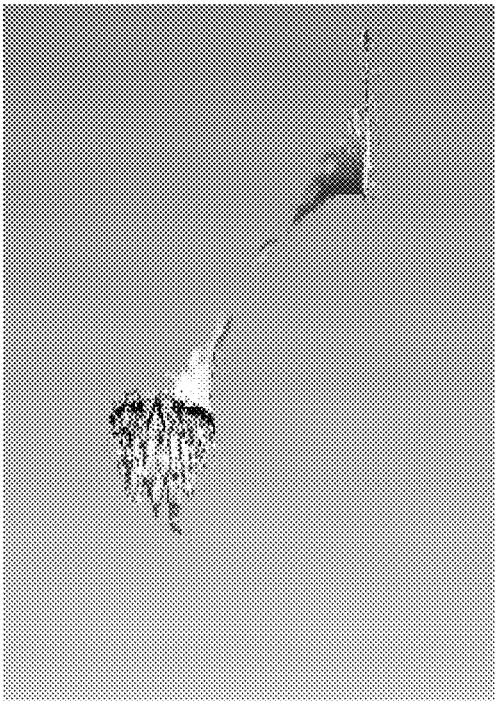
FIG. 3A is a model demonstrating the effects of the tabs on the downstream fluid flow.
Figure 3B:
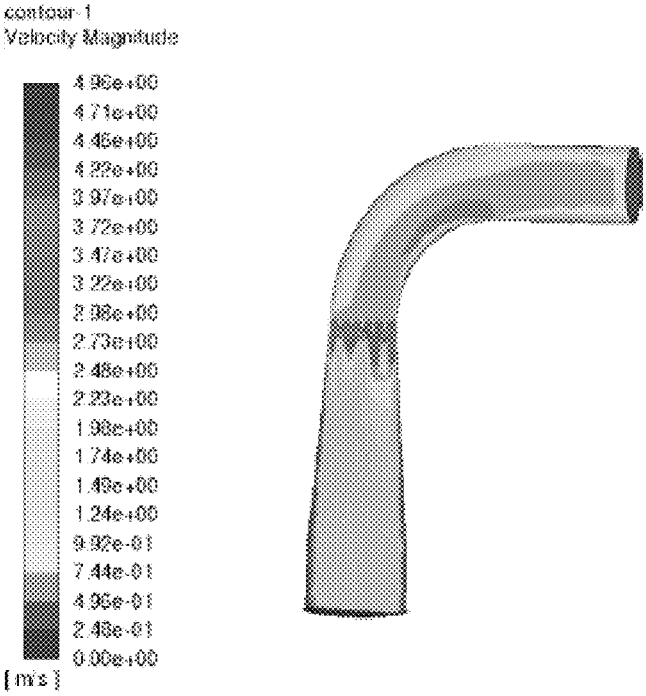
FIG. 3B is a model demonstrating velocity of fluid flow through the conduit.
Figure 3C:
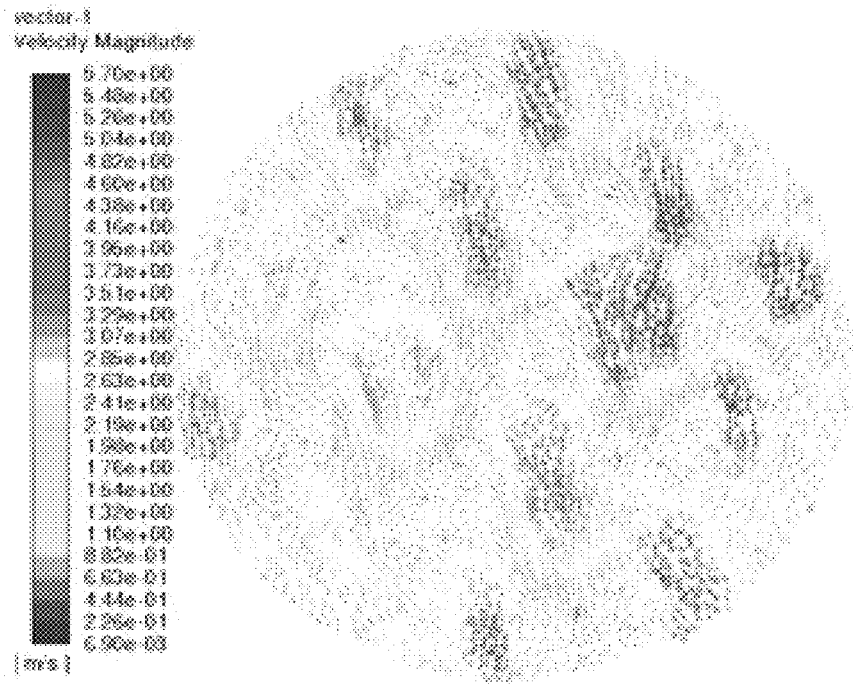
FIG. 3C is a model demonstrating formation of swirling vortices in the fluid flow due to the insertion-type plate flow conditioner.

FIGS. 3A-3C depict that tabs 16 effect the fluid flow by producing vortices. These vortices have axes of rotation directed toward the movement of the fluid. Vortices are moving in a counterclockwise direction, opposite to the direction of the swirl-attenuating flow anomalies stratified in the 90-degree bend. In this manner, tabs 16 facilitate intermixing of the fluid flow within conduit 18, downstream from insertion plate flow conditioner 12.

Next, Table 1 provided below shows that by changing at least one of the angles between tabs 16, the fluid flow downstream from flow conditioner 12 can be further adjusted. In Table 1, $\sigma_h$ and $\sigma_v$ represent the horizontal and vertical flatness efficiency parameters, used to quantify flatness of the flow profile, which is the difference between the fully developed and distorted flow profiles.

TABLE 1

| Angle values | $\sigma_h$ | $\sigma_v$ | $\eta_h$ | $\eta_h$ | $Pt_r$ |
|---|---|---|---|---|---|
| $\alpha_1 = 34$, $\alpha_2 = 50$, and $\alpha_3 = 40$ | 0.25 | 0.16 | 0.75 | 0.06 | 0.050 |
| $\alpha_1 = 45$, $\alpha_2 = 50$, and $\alpha_3 = 40$ | 0.25 | 0.18 | 0.75 | 0.04 | 0.056 |
| $\alpha_1 = 50$, $\alpha_2 = 50$, and $\alpha_3 = 40$ | 0.26 | 0.21 | 0.72 | 0.01 | 0.06 |

The results in Table 1 illustrate that relative efficiency of the flow conditioning process of insertion type flow conditioner 12 has been found relatively low, as the performance of the flow conditioner 12 is dependent on the angle between tabs 16. In addition, reducing the angle of tab 16 in the region of higher velocities aids in development of flatter fluid flow profile. However, angles for other tabs 16 need to be adjusted simultaneously to optimize vortex shedding and achieve minimal pressure drops. This is impossible to achieve with prior art devices, such as those depicted in FIGS. 1A and 1B, which use stationary, rigid tabs.

Insertion Type Flow Conditioner Having Self-Adjusting Tabs

As the data explained above shows, although rigid, non-adjustable tabs 16 of an insertion plate-type flow conditioner 12 improve fluid flow profile, their performance can be further optimized by if the individual angles between cojoined tabs 16 could be adjusted independently of one another based on the local fluid flow properties, such as static and dynamic pressure. However, in prior art flow conditioners, tabs 16 are rigidly affixed to the plate 12 at non-adjustable angels.

Figure 4:
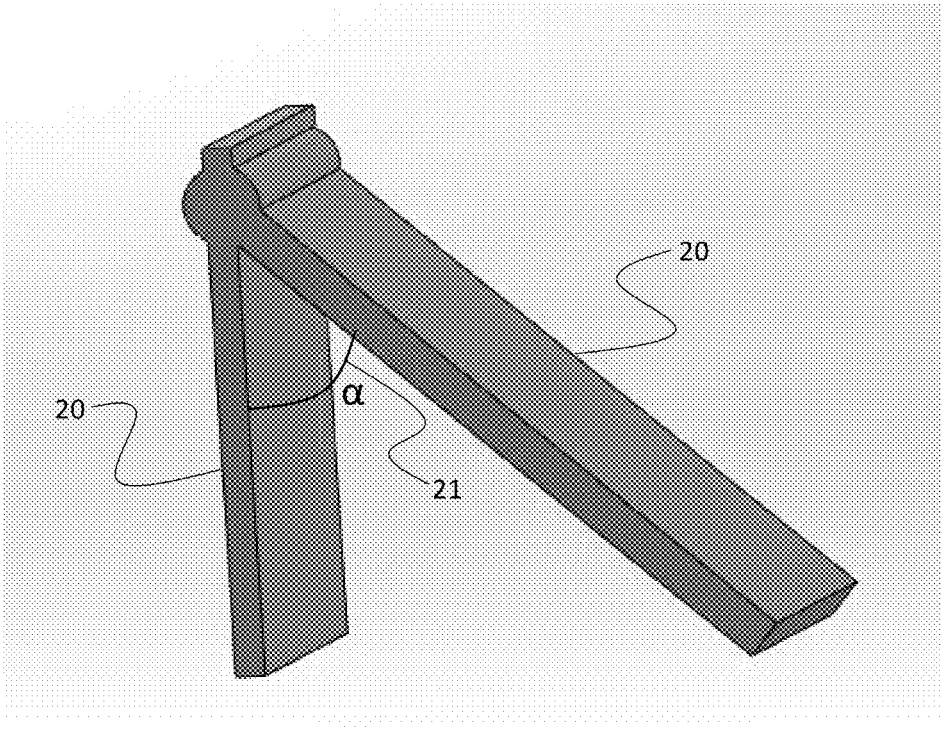
FIG. 4 is a perspective schematic view of a tabular member joined to a support surface.

This problem is now resolved by a novel and nonobvious invention, an embodiment of which is depicted in FIG. 4. A tab 20 is joined to a support surface 19—such as an inner wall of conduit 18 or insertion plate-type flow conditioner 12—an at angle 21. In an embodiment, angle 21 can range between 60 to 30 degrees with respect to the mean axis. At higher angles 21, the total pressure drop of the fluid passing through tab 20 increases. Conversely, when angle 21 between tab 20 and the support surface 19 decreases, the total pressure drop of the fluid flow also decreases. In an embodiment, tab 20 is made from elastomer material configured to undergo an elastic deformation in response to static and dynamic pressure exerted onto tab 20 by the fluid flow. In this manner, tab 20 is configured to bend in response to the change in total pressure of the fluid, which is the sum of dynamic and static pressure. When placed in the path of a fluid flow, angle 21 between tab 20 and the support surface 19 is controlled passively—meaning that tab 20 is configured to deform to orient itself in a shape of least resistance to the fluid flow. In an embodiment, tab 20 can be made from a hyperplastic or a flexible composite material.

Figure 5A:
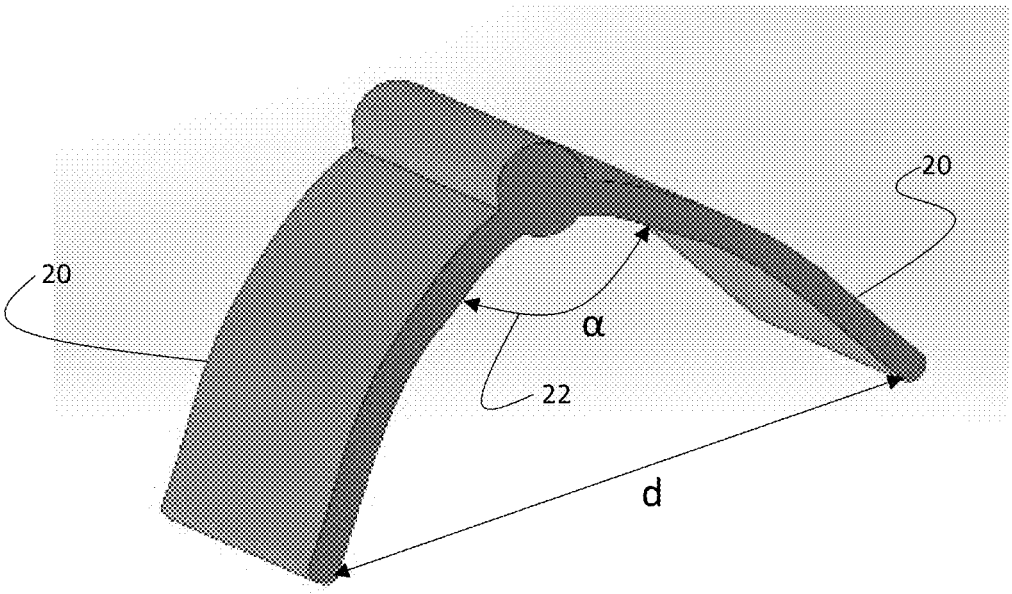
FIG. 5A is a perspective view of two conjoined tabular members in a non-deformed configuration.
Figure 5B:
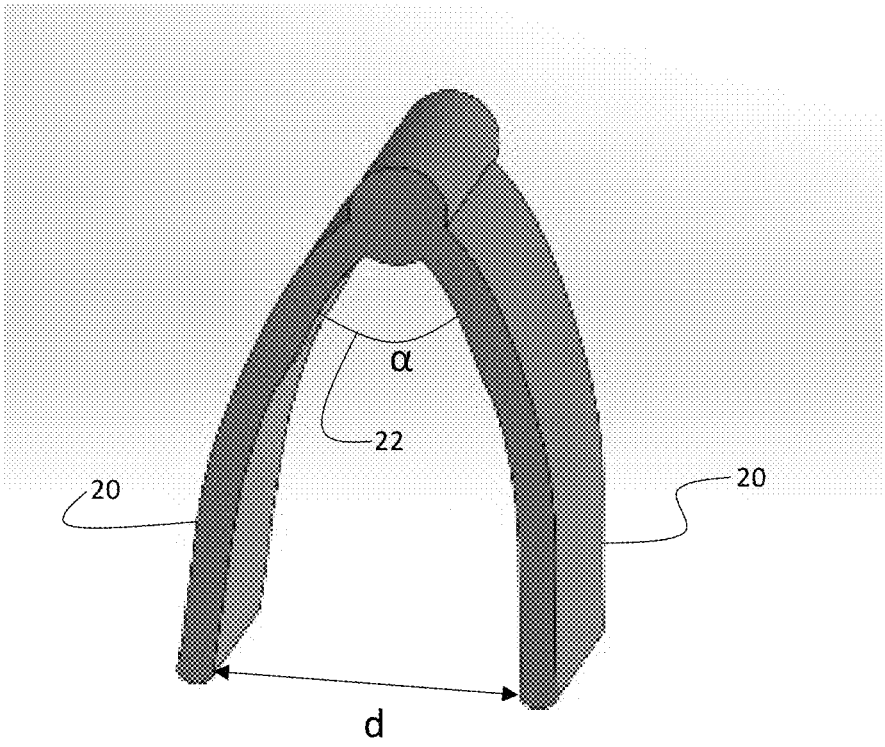
FIG. 5B is a perspective view of two conjoined tabular members in a deformed configuration.

FIGS. 5A and 5B depict an embodiment in which self-adjusting tabs 20 are cojoined together at an angle 22. Analogously to the principles described above, angle 22 between tabs 20 is configured to change in response to changes in dynamic pressure exerted onto outer surfaces of tabs 20 by the fluid flow. In an embodiment, angle 22 between tabs 20 can vary in the range between 60 to 30 degrees with respect to the mean axis. At higher angles 22, the total pressure drop of the fluid passing through tabs 20 increases. Conversely, when angle 22 between tabs 20 decreases, the total pressure drop of the fluid flow also decreases.

As described above with respect to FIG. 4, in the embodiment depicted in FIGS. 5A and 5B, tabs 20 can be manufactured from an elastomeric material configured to undergo an elastic deformation in response to static and dynamic pressure exerted onto tabs 20 by the fluid flow. In this manner, tabs 20 are configured to bend inwardly in response to the change in total pressure of the fluid, which is the sum of dynamic and static pressure. In this embodiment, cojoined tabs 20 can be in manufactured as a monolithic component. When placed in the path of a fluid flow, angle 22 at the vertex of cojoined tabs 20 is controlled passively because cojoined tabs 20 are configured to deform to orient themselves in a shape of least resistance to the fluid flow. In an embodiment, cojoined tabs 20 can be made from a hyperplastic or a flexible composite material.

Figure 5C:
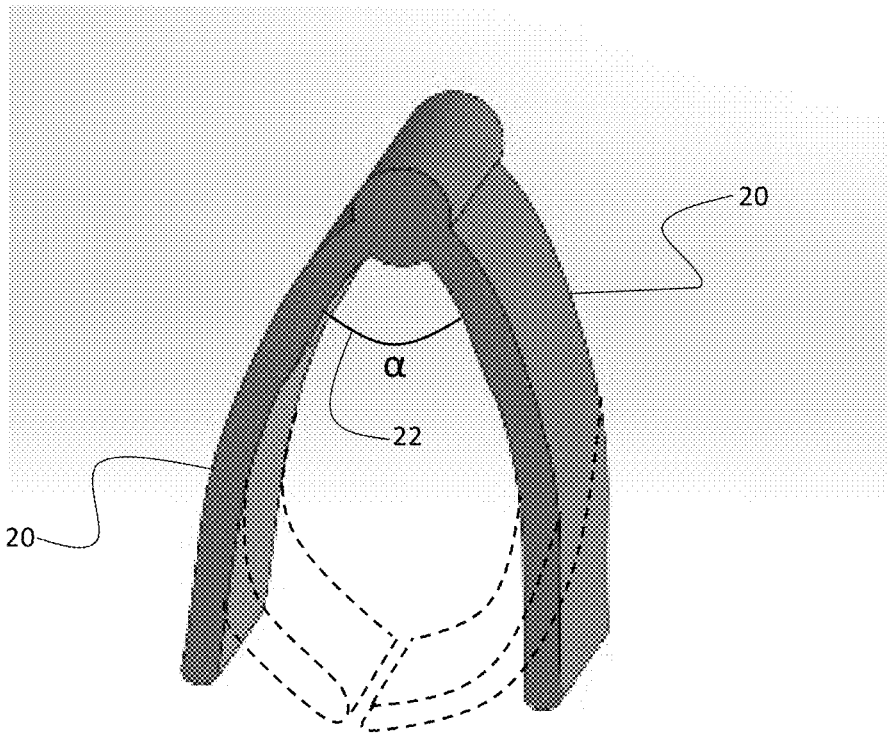
FIG. 5C is a schematic view depicting that tabular members are configured to elastically deform to achieve a collective shape resembling a teardrop shape of an airfoil.

As depicted in FIG. 5C, when subjected to the pressure of the fluid flow, cojoined tabs 20, undergo an elastic deformation to assume a shape approaching a teardrop-shape of an airfoil. This shape of cojoined tabs 20, depicted in FIG. 4B, results in less resistance and improved streamline to the motion of the fluid, relative to the default shape depicted in FIG. 4A. Furthermore, because each cojoined pair of tabs 20 deforms independently of other pairs of tabs 20, every cojoined pair of tabs 20 can achieve a different angle corresponding to the localized dynamic pressure of the fluid flow at that specific location relative to plate-type flow conditioner 12.

If the characteristics of the upstream fluid flow change, angles 22 between each cojoined pair of tabs 20 will passively (without requiring any external input) readjust based on the instantaneous pressure the fluid flow exerts on each tab-pair 20 at that instance. Thus, if the velocity of the upstream fluid flow decreases, the static and dynamic pressure exerted onto tabs 20 by the fluid flow will also decrease—in which case, the tabs 20 will partially straighten, increasing angle 22 therebetween. Conversely, as the pressure of the upstream fluid flow increases, tabs 20 will bend more, decreasing angle 22 therebetween. These adjustments are achieved passively, based on the static and dynamic pressure of the fluid flow, without requiring any manual adjustment of tabs 20 or involvement of sensors and motors to actively control angles 22 therebetween. Furthermore, the trailing edges of tabs 20 can have a tapered—i.e., airfoil-like shape—to reduce the pressure drop as the fluid flow passes over the cojoined tabs 20.

In this manner, tabs 20 are configured to self-adjust in response to change in Reynold's number of the fluid around tabs 20. As the Reynold's number of the fluid flow increases, the dynamic pressure exerted by the fluid onto the surface areas of tabs 20 also increases, causing the tabs 20 to bend inwardly. As tabs 20 undergo elastic deformation angle 22 between them decreases. In this manner, each cojoined pair of tabs 20 achieves a configuration that offers minimal resistance to fluid flow, thereby decreasing the pressure drop through the flow-conditioning device 12. Furthermore, another advantage of flexible tabs 20 is that, when subjected to turbulent flow, they will "flap" in response to the dynamic pressure of the fluid flow, thus facilitating intermixing of the fluid downstream.

The properties of the material from which tabs 20 are made dictates the amount of elastic deformation that tabs 20 will undergo in response to the total pressure exerted by the fluid flow. The material will bend and tabs 20 will streamline themselves approaching a shape of an airfoil, thereby reducing the total resistance of cojoined tabs 20, and therefore, the drag forces that cojoined tabs 20 will experience from the fluid. Furthermore, elasticity of the material enables tabs 20 to exhibit flapping, which helps generate vortices to perform fluid intermixing.

Figure 6A:
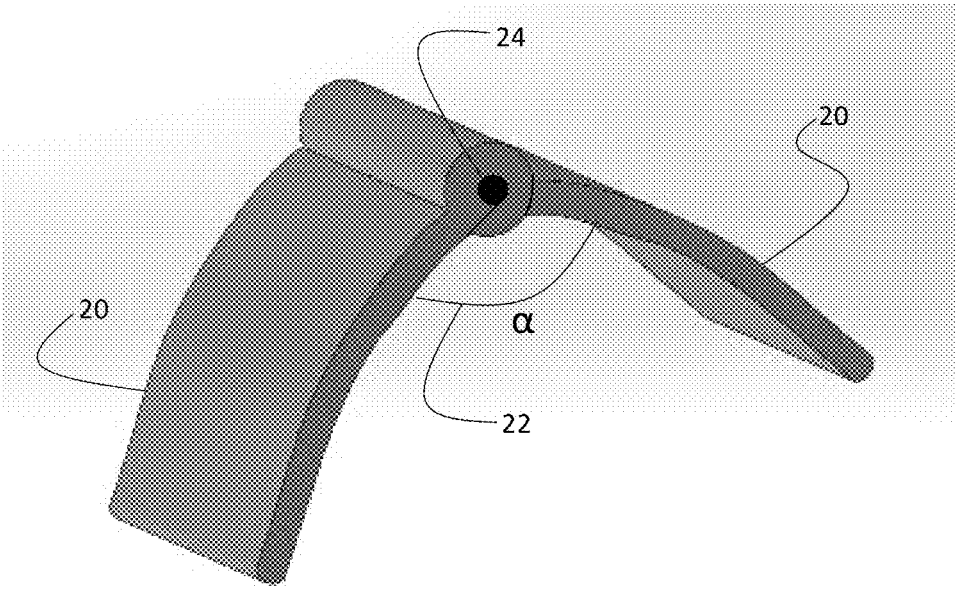
FIG. 6A is a perspective view of two conjoined tabular members connected via a hinge in an open configuration.
Figure 6B:
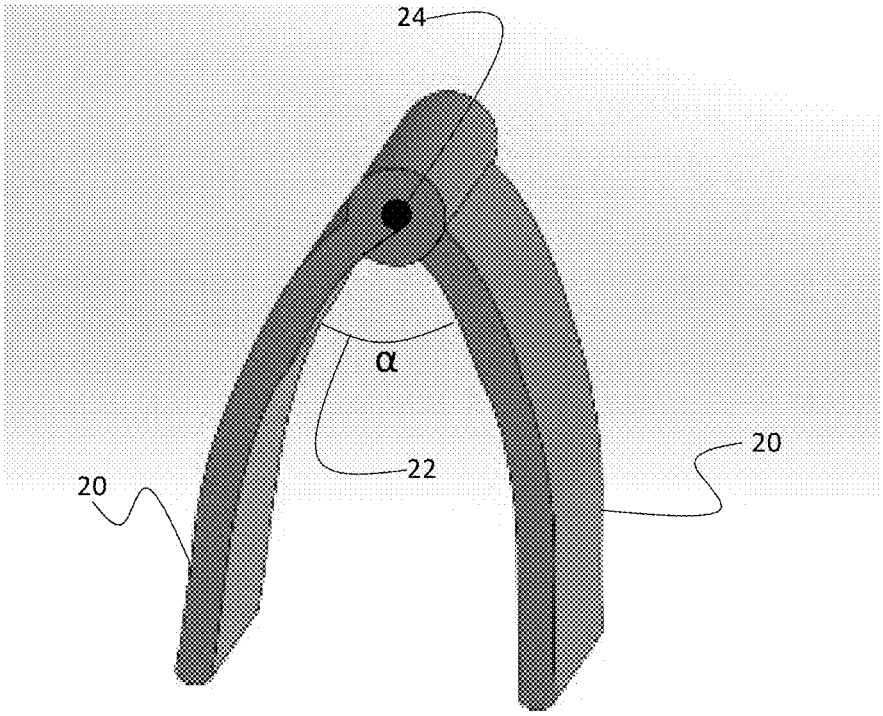
FIG. 6B is a perspective view of two conjoined tabular members connected via a hinge in a partially closed configuration.

In an embodiment depicted in FIGS. 6A-6B, pair of tabs 20 are cojoined via a hinge 24. (Hinge 24 can also be used to join a single tab 20 to support surface 19, with the principles described below being applicable to the embodiment depicted in FIG. 4). The resistance of hinge 24 dictates the change in angle 22 due to increase in pressure exerted onto tabs 20 by the fluid flow. In addition, hinge 24 may be biased (for example, spring-loaded). When using biased hinge 24, the pressure exerted by the fluid flow onto tabs 20 will counteract the biasing force, thereby partially closing hinge 24 to reduce angle 22 between tabs 20. When the pressure of the fluid flow decreases, the biasing force of hinge 24 will cause tabs 20 to pivot outward about the hinge axis, thereby increasing angle 22 therebetween. In this embodiment, tabs 20 may be made of a rigid material because angle 22 is controlled by hinge 24 and is not dependent solely on elastic deformation of tabs 20.

Figure 7A:
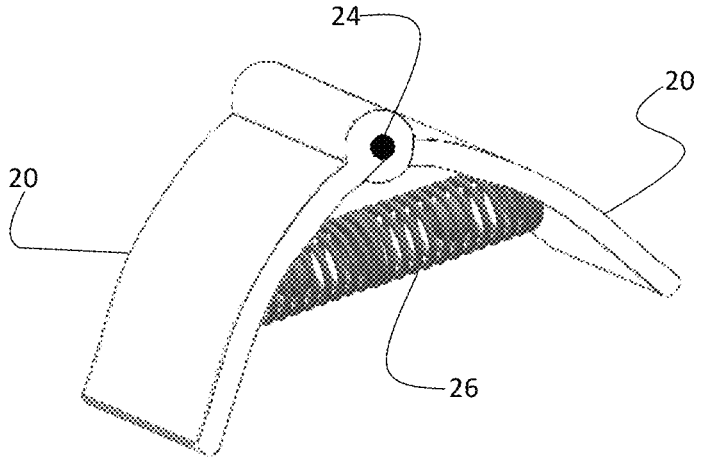
FIG. 7A is a schematic view of two conjoined tabular members connected via a hinge and a biasing element, in an open configuration.
Figure 7B:
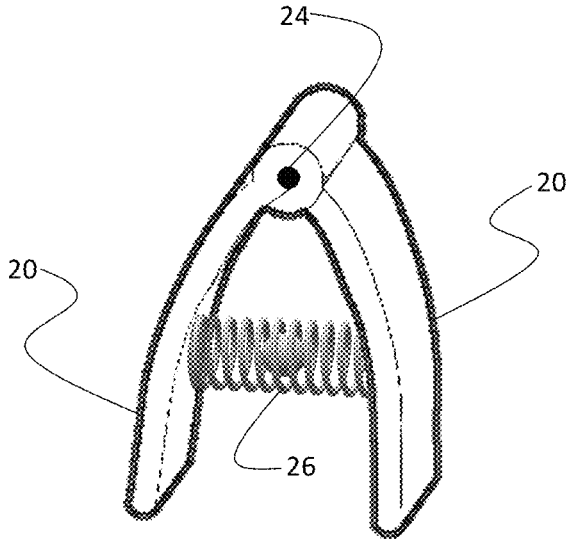
FIG. 7B is a schematic view of two conjoined tabular members connected via a hinge and a biasing element, in a partially closed configuration.

Yet another embodiment is depicted in FIGS. 7A-7B. In this embodiment, a biasing element 26—for example, a spring—is positioned between adjacent tabs 20. (Biasing element 26 can also be implemented with a single-tab embodiment depicted in FIG. 4 by disposed biasing element 26 between tab 20 and support surface 19). In this embodiment, Hooke's constant (stiffness) of biasing element 26 will dictate the amount by which angle 22 changes in response to an increase or a decrease in pressure exerted onto tabs 20 by the fluid flow. As the pressure of fluid flow onto surface areas of tabs 20 increases, biasing element 26 will compress, reducing angle 22 between tabs 20. Conversely, as the pressure exerted onto tabs 20 by the fluid flow decreases, the biasing force of biasing element 26 will push tabs 20 further apart, increasing angle 22 therebetween. Even in the embodiments that involve hinge 24 and/or biasing element 26, tabs 20 may be made form an elastomer (hyperplastic) material to facilitate flapping behavior in response to changes in dynamic pressure of the fluid flow. Alternatively, in this embodiment, tabs 20 can be rigid, in which case they will generate tip vortices in the downstream fluid flow.

Additional Fluid Flow Conditioning Mechanisms

Figure 8A:
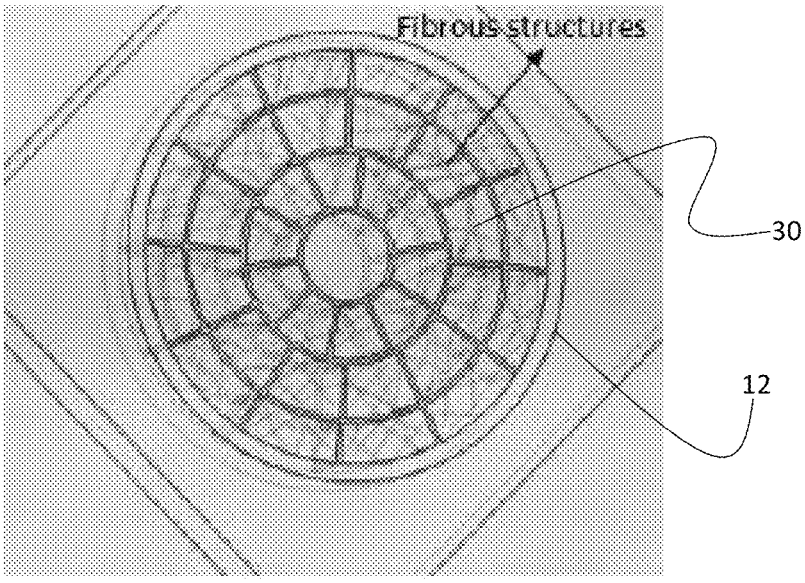
FIG. 8A is a schematic view depicting fibrous structures disposed within apertures of the plate-type flow conditioner.

FIG. 8A depicts flexible microstructures 30 positioned in and across the passages of a fluid flow conditioning plate. Flexible microstructures 30 inhibit formation of laminar boundary flow at flow bounding surfaces, and therefore reduce pressure losses in downstream fluid flow. Initially, as the fluid flow passes over the boundary walls of the conditioning plate, the laminar boundary flow experiences separation from the surface due to presence of adverse pressure gradient. This leads to development of recirculation regions within the volume of the passage. These recirculation zones extract energy from the freestream fluid, creating pressure drops as the fluid flow passes through the plate.

Figure 8B:
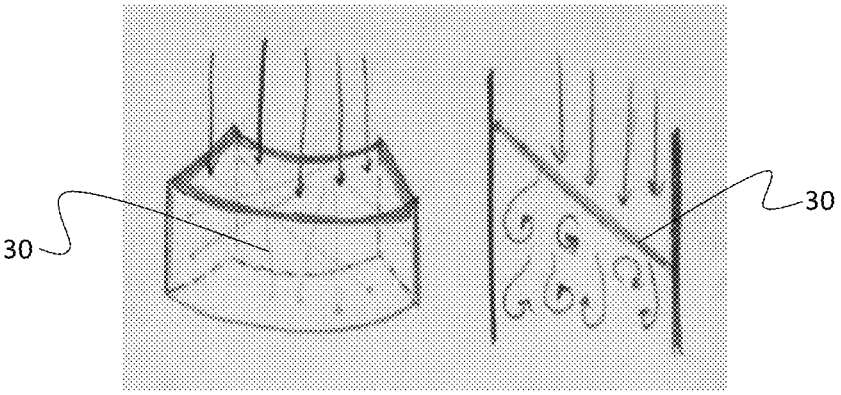
FIG. 8B is a schematic view depicting fibrous structures facilitating generation of eddies in a downstream fluid flow.

FIG. 8B depicts that flexible microstructures 30 running in and across the volume of the apertures within the plate function as bluff bodies in the flow direction, thereby aiding in the creation of eddies. The swirling eddies in the downstream flow prevent the flow from becoming laminar in the boundary flow region, due random intermixing of fluid particles, enhanced by eddy formation.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. A fluid flow conditioning apparatus, comprising:

a first tabular member having a first leading edge, a first trailing edge, a first outer surface, and a first inner surface;

a second tabular member having a second leading edge, a second trailing edge, a second outer surface, and a second inner surface, wherein the second leading edge of the second tabular member is cojoined with the first leading edge of the first tabular member, the first and the second tabular members collectively forming a tabular assembly;

wherein, responsive to the tabular assembly being placed into a first fluid flow having a first Reynold's number and a first dynamic pressure, the tabular assembly is configured to change a shape thereof such that the first and the second tabular members are positioned at a first angle relative one another and the first trailing edge and the second trailing edge are separated by a first distance; and wherein, responsive to the tabular assembly being placed into a second fluid flow having a second Reynold's number and a second dynamic pressure, wherein the second Reynold's number is greater than the first Reynold's number or the second dynamic pressure is greater than the first dynamic pressure, the tabular assembly is configured to change the shape thereof such that the first and the second tabular members are positioned at a second angle relative one another and the first trailing edge and the second trailing edge are separated by a second distance, wherein the first angle is greater than the second angle and the first distance is greater than the second distance.

2. The fluid flow conditioning apparatus of claim 1, wherein the first and the second tabular members are made of an elastomeric material.

3. The fluid flow conditioning apparatus of claim 2, wherein the elastomeric material is configured to undergo an elastic deformation in response to changes of the dynamic pressure of the first fluid flow.

4. The fluid flow conditioning apparatus of claim 3, wherein the elastic deformation of the elastomeric material reduces a drag coefficient of the tabular assembly.

5. The fluid flow conditioning apparatus of claim 3, wherein the first tabular member and the second tabular member are configured to exhibit flapping in response to changes in the dynamic pressure of the first fluid flow.

6. The fluid flow conditioning apparatus of claim 5, wherein flapping of the first tabular member and the second tabular member generates vortices in a downstream fluid flow, thereby increasing intermixing thereof.

7. The fluid flow conditioning apparatus of claim 1, wherein the first tabular member and the second tabular member are cojoined via a hinge.

8. The fluid flow conditioning apparatus of claim 7, wherein the hinge is biased toward an open configuration, and wherein the dynamic pressure exerted onto the first outer surface of the first tabular member and the second outer surface of the second tabular member by the first fluid flow at least partially closes the hinge against the biasing force.

9. The fluid flow conditioning apparatus of claim 8, wherein the biasing force is configured to at least partially open the hinge in response to a reduction in the dynamic pressure exerted onto the first outer surface of the first tabular member and the second outer surface of the second tabular member.

10. The fluid flow conditioning device of claim 7, wherein a biasing element is disposed between the first inner surface of the first tabular member and the second inner surface of the second tabular member, the biasing element configured to bias the hinge toward an open configuration.

11. The fluid flow conditioning device of claim 10, wherein the dynamic pressure exerted onto the first outer surface of the first tabular member and the second outer surface of the second tabular member by the first fluid flow partially closes the hinge against a biasing force of the biasing element.

12. The fluid flow conditioning apparatus of claim 7, wherein the first tabular member and the second tabular member are made of a rigid material.

13. The fluid flow conditioning apparatus of claim 12, wherein the first tabular member and the second tabular member are configured to generate tip vortices in a downstream fluid flow, thereby increasing intermixing thereof.

14. The fluid flow conditioning apparatus of claim 1, wherein a plurality of the tabular assemblies is disposed on an insertion plate-type flow conditioner.

15. The fluid flow conditioning apparatus of claim 14, wherein a plurality of flexible microstructures is disposed within apertures of the insertion plate-type flow conditioner, whereby the plurality of flexible microstructures is configured to facilitate creation of eddies within a downstream fluid flow.

16. A fluid flow conditioning apparatus, comprising:

a first tabular member having a first leading edge, a first trailing edge, a first outer surface, and a first inner surface, wherein the first leading edge of the first tabular member is configured to be joined to a support surface within a conduit;

a second tabular member having a second leading edge, a second trailing edge, a second outer surface, and a second inner surface, wherein the second leading edge of the second tabular member is cojoined with the first leading edge of the first tabular member such that respective first and second trailing edges define an angle between the first and second tabular members;

wherein, responsive to a fluid flow within the conduit, the angle between the first and second tabular members is configured to change in response to changes in a Reynold's number or a dynamic pressure of the fluid flow.

17. The fluid flow conditioning apparatus of claim 16, wherein the first tabular member is configured to undergo an elastic deformation in response to an increase in the dynamic pressure of the fluid flow being exerted onto the first outer surface of the first tabular member.

18. The fluid flow conditioning apparatus of claim 17, wherein the first tabular member is made of an elastomeric material.

19. The fluid flow conditioning apparatus of claim 16, wherein the first tabular member is joined to the support surface via a hinge.

20. The fluid flow conditioning apparatus of claim 16, further comprising a biasing element configured to exert a force onto the first tabular member, the second tabular member, or both the first and second tabular members, wherein the dynamic pressure exerted onto the first outer surface of the first tabular member or the second outer surface of the second tabular member by the fluid flow is configured to overcome the force of the biasing element, thereby decreasing the angle between the first tabular member and the second tabular member.

* * * * *